US005472400A

United States Patent [19]

Royer

[11] Patent Number: 5,472,400

[45] Date of Patent: Dec. 5, 1995

[54] PUSH-UP EXERCISE APPARATUS

[76] Inventor: Christopher J. Royer, 21 Tideview Dr., Dover, N.H. 03820

[21] Appl. No.: 395,084

[22] Filed: Feb. 27, 1995

[51] Int. Cl.[6] ..... A63B 26/00

[52] U.S. Cl. ..... 482/141; 482/49

[58] Field of Search ..... 482/141, 148, 482/44, 49, 50, 121, 126, 128, 127, 79, 82

[56] References Cited

U.S. PATENT DOCUMENTS 4,093,211 6/1978 Hughes et al. .
4,232,863 11/1980 Roach .
4,351,525 9/1982 Rozenblad .
4,610,448 9/1986 Hill .
4,763,896 8/1988 Press .
4,798,377 1/1989 White .
5,205,802 4/1993 Swisher .
5,308,299 5/1994 Winston .

*Primary Examiner*—Stephen R. Crow
*Attorney, Agent, or Firm*—Steven G. Saunders

[57] ABSTRACT

A push-up exercise apparatus for simultaneously exercising the muscles of the upper body, wrist, and forearms is disclosed. The apparatus comprises a base to elevate the hands of a user above the underlying surface, and at least two hand exercisers connected to a rigid member that is coupled to the base. The hand exerciser includes a pair of elongated fingers, a torsion spring pivotally connected between the fingers, and a spring band to limit spring expansion.

22 Claims, 3 Drawing Sheets

PUSH-UP EXERCISE APPARATUS

FIELD OF THE INVENTION

This invention relates generally to an exercise apparatus, and more particularly concerns a push-up exercise apparatus that is capable of simultaneously exercising the muscles of the upper body, wrists, and forearms.

BACKGROUND OF INVENTION

Exercise devices that provide a raised base for elevated push-ups are known in the art. U.S. Pat. No. 4,351,525 to Rosenblad, for example, discloses a device that assists the user in performing push-ups. The device incorporates handle projections that are placed on the floor and grasped by the user to effectively put the user into a more elevated position. Such elevated position effectively increases the range of motion through which the user moves, thus enabling the user to obtain increased muscle conditioning. The device is adjustable for varying push-up type exercises and body types, i.e., two separate and identical handles are used and can be positioned as desired. Although Rosenblad provides a push-up platform that adequately works the upper body (primarily the chest and shoulders), however, it does not enable the user to strengthen such user's wrists and forearms as the push-up is executed. An additional device and/or exercise is required to accomplish such a goal.

Hand exercisers that strengthen the wrist and forearm muscles by compressing a torsion spring are known in the art. U.S. Pat. No. 5,308,299 to Winston, for example, discloses such a device that includes a torsion spring connected between two hand grips that are used to compress the spring. Spring compression by a user requires a degree of force that eventually fatigues the wrist and forearm muscles, thus strengthening the noted muscles. U.S. Pat. No. 4,763,896 to Press shows a similar device. The exclusive use of such devices, however, does not fatigue or strengthen the muscles of the upper body. An alternative exercise and/or device is required to accomplish such function.

There have been attempts in the prior art to simultaneously strengthen two independent muscle groups. U.S. Pat. No. 4,798,377 to White shows the combination of a bicycle handle bar and hand exerciser as described above. Such device is capable of simultaneously strengthening the legs and forearm muscles. The device, however, is neither capable, nor adaptable to upper body strengthening and conditioning. It is impractical, if not impossible, for any user to perform push-ups on the device. U.S. Pat. No. 4,093,211 to Hughes et al. similarly discloses the combination of hand exercisers and a flexible jump rope. In like fashion, such a device is not capable of being used for elevated push-ups or any push-up type exercise.

U.S. Pat. No. 4,610,448 to Hill and U.S. Pat. No. 5,205,802 to Swisher both disclose elevated push-up exercise devices having rotatable hand grips. The primary object of both devices is to minimize injury to the arm when performing elevated push-ups. Neither device, however, simultaneously strengthens the muscles of the upper body, wrists, and forearms.

Accordingly, there is a great need for a exercise device that simultaneously strengthens the upper body muscles, the forearm muscles, and the wrist muscles, and is adapted specifically to be used by a person while doing push-ups. There is a further need for a device as described above that is adaptable to be used with other exercise devices.

SUMMARY OF THE INVENTION

It is therefore an object of this invention to provide an apparatus that simultaneously exercises the muscles of the upper body, wrists, and forearms of a user.

It is also an object of this invention to provide a push-up exercise apparatus that simultaneously exercises the muscles of the upper body, wrists, and forearms of a user.

It is a further object of this invention to provide a push-up exercise apparatus that exercises multiple muscle groups that further is adaptable to be used in conjunction with additional exercise equipment.

It is another object of this invention to provide a stable push-up exercise apparatus that is not readily movable upon its supporting surface when in use.

This invention results from the realization that a more complete muscular conditioning regimen is attained by using an apparatus that permits the simultaneous fatiguing of the muscles of the upper body, wrists, and forearms. Such improved results are efficiently accomplished by combining an elevated base with hand exercisers.

The above and other objects are achieved in accordance with the present invention which, according to a first aspect provides a push-up exercise apparatus comprising a base that elevates the hands of a person above the underlying surface, at least two hand exercisers, and a rigid member connected to the base. The hand exercisers include a resilient coil spring having a first and second end that both extend perpendicularly away from a pivot axis to form an acute angle between the ends, a spring band connected to each spring end to limit spring expansion, and a finger grip at the first end of the spring. The rigid member, which is preferably straight, has a means for removably coupling the rigid member to the base and a means for coupling to the second ends of the hand exercisers. The preferred base includes a cross-member connected between a first and second support bar, where the cross-member is connected to the rigid member. An alternative base includes a first and second U-shaped support member that are both removably coupled to the rigid bar.

Other and further objects, as well as various advantages and features of novelty which characterize the invention, are pointed out with particularity in the claims annexed hereto and forming a part hereof. However, for a better understanding of the invention, its advantages, and objects obtained by its use, reference should be made to the drawings and to the accompanying descriptive matter which illustrate and describe a preferred embodiment of the invention.

BRIEF DESCRIPTION OF THE DRAWINGS

Turning first to FIG. 1, there is shown a perspective view of a preferred embodiment of the push-up exercise apparatus constructed according to the principles of the present invention.

DISCLOSURE OF PREFERRED EMBODIMENT

Figure 1:
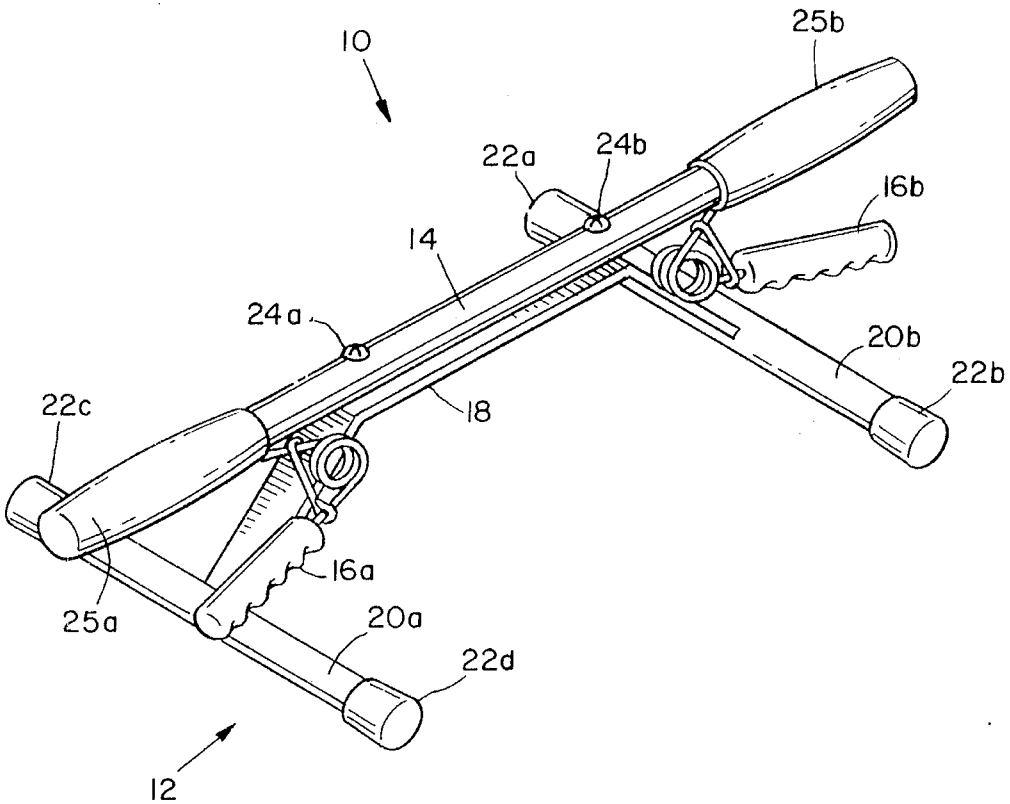

There is shown in FIG. 1 a preferred embodiment of the invention as claimed. Specifically, a push-up exerciser 10 is disclosed having a base 12, a straight, rigid member 14, and hand exercisers 16*a* and 16*b*.

Base 12 includes a cross member 18 connected between a first support bar 20*a* and a second support bar 20*b*. Support bars 20*a* and 20*b* support exerciser 10 upon an underlying surface and further include a plurality of rubber or plastic stops 22*a*–22*d* concentrically fastened to the ends of bars 20*a* and 20*b*. Stops 22*a*–22*d* function as edge protectors for exerciser 10 as they further enhance stability to prevent exerciser 10 from moving in response to the operational forces applied to exerciser 10. Both functions are important to increase the safety and efficiency of exerciser 10. Cross member 18 connects longitudinally to rigid member 14 at a point equidistant between the ends of rigid member 14. A first screw 24*a* and a second screw 24*b* both couple rigid member 14 to cross member 18. Screws 24*a* and 24*b* may be the type that either fasten directly into the members, with or without a fastening nut, butterfly nut, or similar apparatus. The addition of a nut as noted above enables rigid member 14 to be removed from base 12 and coupled to another piece of exercise equipment having corresponding coupling means. Such corresponding coupling means includes an adjustable sleeve that secures rigid member 14, or aligned bolt holes. Any fastening means known in the art, however, will suffice. Cross member 18 is essentially the shape of a downward-faced, half of a six sided polygon, thus providing the elevated base feature. Such feature allows for a greater range of motion when performing push-ups, thus more completely working the upper body muscles.

Figure 2:
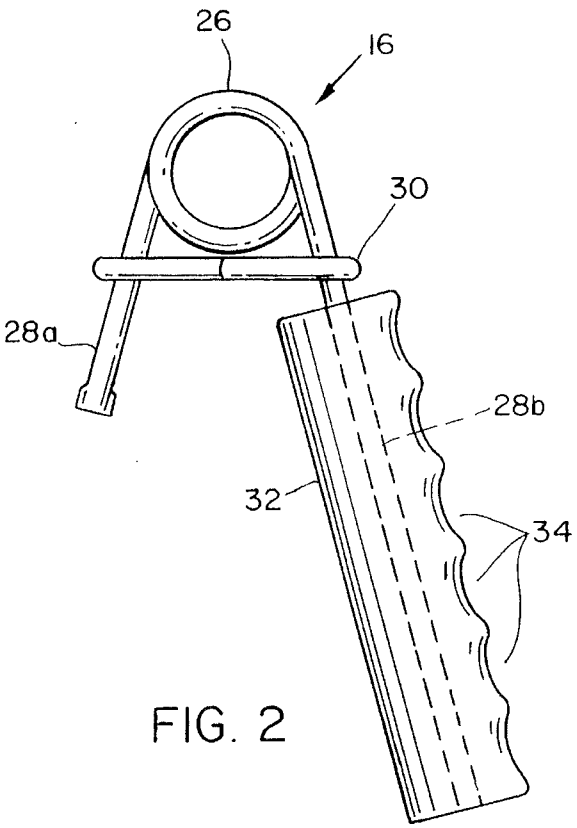
FIG. 2 shows a front view of a torsion spring hand exerciser which makes up a part of the combination of the present invention.

Hand exercisers 16*a* and 16*b* are coupled to rigid member 14, preferably at a point that is close to the ends of rigid member 14. A first hand grip 25*a* and a second hand grip 25*b* are fastened to the ends of rigid member 14 and are designed to functionally cooperate with hand exercisers 16*a* and 16*b*. As is better demonstrated in FIG. 2, there is shown a hand exerciser 16 that is identical to hand exercisers 16*a* and 16*b*. Specifically, hand exerciser 16 includes a resilient torsion coil spring 26 having a first end 28*a* and a second end 28*b*. Both ends 28*a* and 28*b* extend perpendicularly away from a pivot axis at the center of spring 26 to form an acute angle between the ends 28*a* and 28*b*. Because ends 28*a* and 28*b* extend away from spring 26, they may also be referred to as fingers pivotally connected to spring 26. Spring band 30 is further included between ends 28*a* and 28*b* to limit spring expansion, thereby maintaining the structural integrity of hand exerciser 16. A finger grip 32, which is preferably manufactured of a flexible foam, rubber, plastic, or other material that provides an efficient contact surface, further has a plurality of finger slots 34 that are mounted about end 28*a* to enable a user to grip hand exerciser 16. Finger slots 34 provide the user with a better gripping surface upon hand exerciser 16.

Spring 26 is preferably a torsion coil spring with a spring constant K high enough to require a degree of resistance that will fatigue a user's wrist and forearm muscles. Similarly, constant K must not be such a high value that would require an inordinate amount of force for compression. Spring 26 preferably has two turns, although one turn will suffice. The number of turns directly effects the value of spring constant K.

Hand exercisers 16*a* and 16*b* are coupled to rigid bar 14 by conventional fastening and connection techniques known in the art. Examples include direct bolting or welding of spring end 28*a* to rigid member 14 and the coupling of spring end 28*a* directly to each respective hand grip 25*a* and 25*b*. In the latter example, handles 25*a* and 25*b* are adjustable along the length of rigid member 14, thus enabling the user to vary the grip and effectively work different muscle groups in the upper body. Hand grips are preferably manufactured of a flexible foam, plastic, rubber, or other material that is durable and capable of providing a solid grip for a user.

Figure 3:
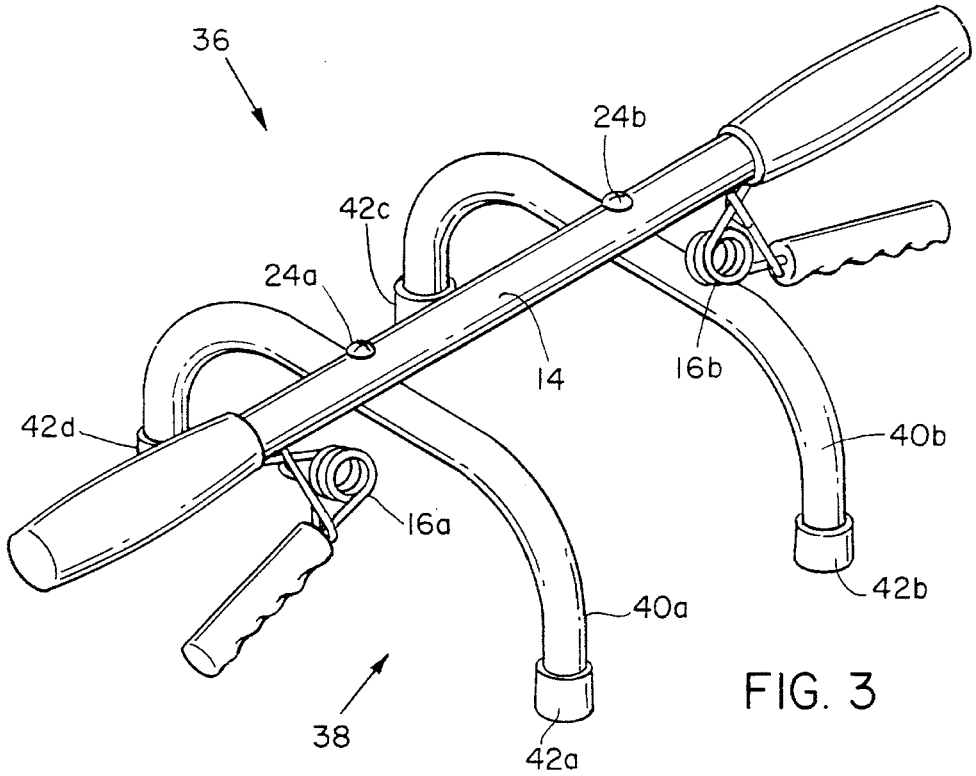
FIG. 3 shows a perspective view of an alternative embodiment of the push-up exercise apparatus.

FIG. 3 shows an alternative embodiment of the invention as claimed. Specifically a push-up exerciser 36 is shown having rigid member 14, hand exercisers 16*a* and 16*b*, and an alternative base 38.

Base 38 comprises a first U-shaped support member 40*a* and a second U-shaped support member 40*b* that are both coupled directly to rigid member 14. Base 38 similarly is elevated because support members 40*a* and 40*b* are turned downwardly and terminate with feet 42*a*–42*d* that are concentrically mounted upon the ends of support members 40*a* and 40*b*. Feet 42*a*–42*d* are preferably manufactured of rubber to prevent exerciser 10 from moving in response to the operational forces applied to exerciser 10. Any material that provides such a function will suffice, however, including plastic, foam, or other material.

STRUCTURAL EXAMPLE

In the preferred embodiment of push-up exerciser 10, rigid member 14 is 22.0 inches in length and terminates in hand grips 25*a* and 25*b*. Hand exercisers 16*a* and 16*b* are each welded directly onto the ends of rigid member 14 and each include steel torsion spring 26 having two turns and foam finger grips 32. Cross member 18 is a flat steel plate 1.0 inch wide and 0.25 inches thick. Support bars 20*a* and 20*b* are 10.0 inches in length and are connected at their centers to cross member 18. Rigid member 14 and support bars 20*a*–20*b* are each manufactured of 0.875 tubular steel. 1.25 inch steel screws 24*a* and 24*b* couple rigid member 14 to cross member 18.

Figure 4:
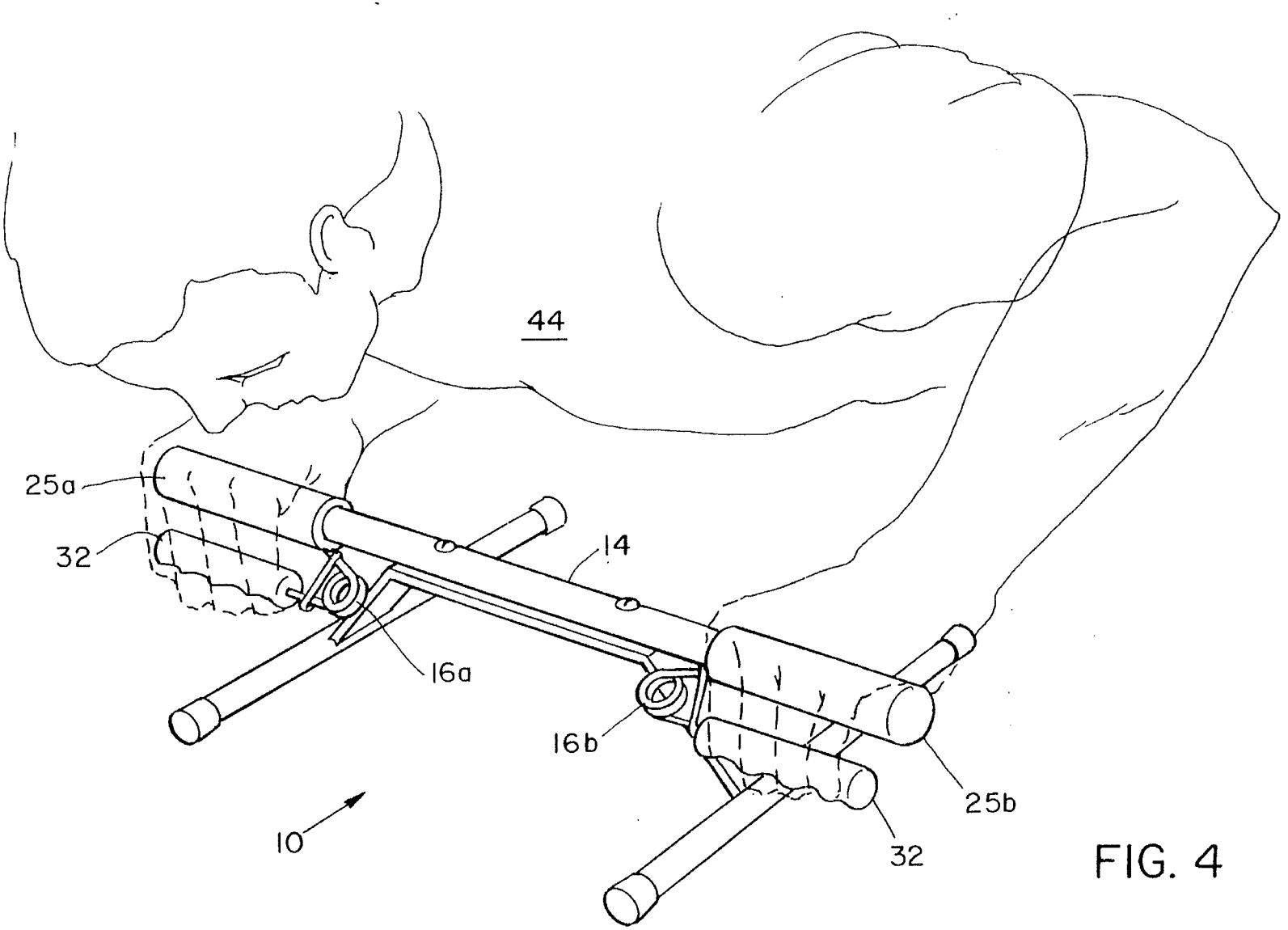
FIG. 4 shows a preferred method of practice of the preferred embodiment.

FIG. 4 shows a preferred method of practice of the preferred embodiment. A user 44 grips hand grips 25*a* and 25*b* with his palms and grips finger grips 32 with his fingers. As user 44 executes a push-up, the hands of user 44 compress spring 26 by squeezing the ends 28*a* and 28*b* of spring 26 together. Such action simultaneously strengthens the muscles of the upper body, wrist, and forearm. The angle of the push-up can be adjusted by placing the user's feet upon some elevating means. Accordingly, varying muscle groups in the upper body can be exercised.

Figure 5:
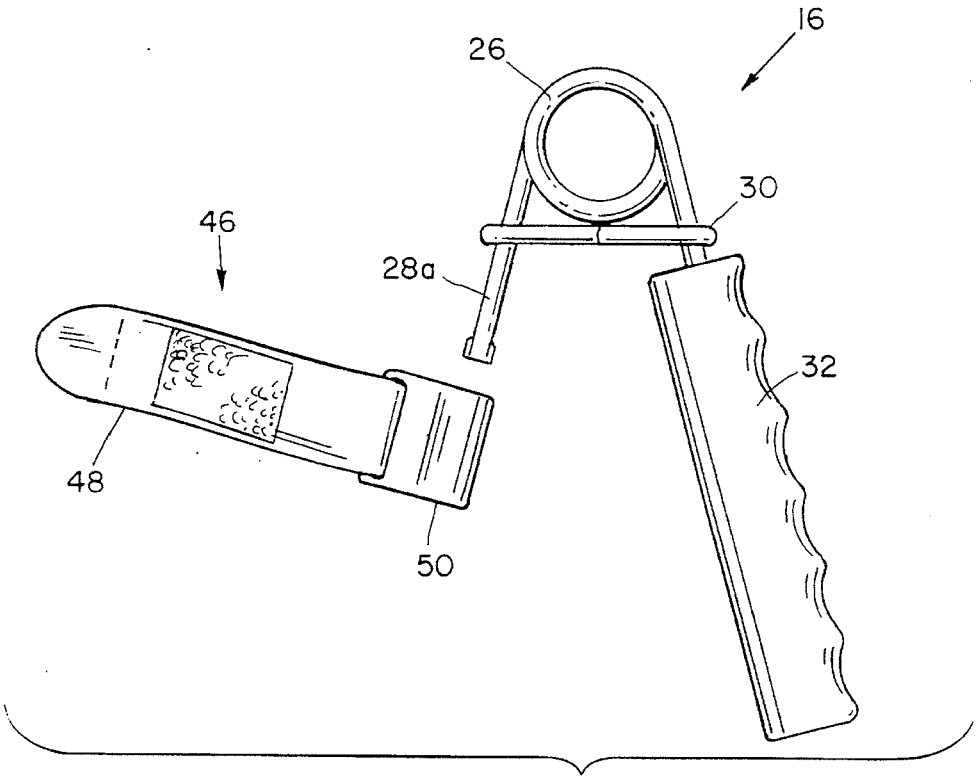
FIG. 5 shows a front view of an alternative embodiment of the torsion spring hand exerciser having a "VELCRO" strap.

FIG. 5 shows a front view of an alternative embodiment of the hand exerciser 16 having a "VELCRO" connection means 46. The "VELCRO" connection means 46 is utilized so that hand exerciser 16 is removable from rigid member 14 and capable of being coupled to another object. Such feature further adds to the diversity of push-up exerciser 10. "VELCRO" connection means 46 includes a "VELCRO" strap 48 looped through a clip 50 that is adapted to wrap around spring end 28*a* and rigid member 14 or other object. "VELCRO" refers to a trademark for synthetic materials which adhere when pressed together. The term "synthetic connector" shall be defined as "VELCRO".

Although the preferred and several alternative embodiments have been disclosed, the invention may be practiced through the use of many different configurations and variances from such embodiments. Any means to elevate rigid member 14 will suffice. Such elevation means, however, must be adaptable to be used for push-ups. Furthermore, rigid member 14 may be any odd or curved shape and hand grips 25*a* and 25*b* may rotate to follow the natural motion of the human body, similar to the handles of U.S. Pat. No. 4,610,448 to Hill and U.S. Pat. No. 5,205,802 to Swisher, incorporated herein by reference. The base 12 and rigid member 14 may be manufactured of a hard plastic to reduce the weight of exerciser 10 and the overall manufacturing cost. Such a device would then be manufactured according to conventional injection molding processes.

Exerciser 10 has been disclosed to be adaptable to use with additional exercise equipment. Rigid member 14, which is removably coupled to base 12, may be coupled to a stationary bike, nautilus machine, universal machine, stepping machine, or other exercise equipment known in the art. Furthermore, exerciser 10 may be broken down into a kit, comprising base 12, rigid member 14, and hand exercisers 16*a* and 16*b* with their various embodiments. Each element of the kit is adapted to be coupled to its corresponding part to form completed exerciser 10.

This invention is characterized by its simplicity of design and ease of use. Accordingly, the invention is inexpensive to manufacture and easy to operate. One fundamental advantage gained through the use of the invention is the fact that a user can simultaneously strengthen the muscles of the upper body, wrist, and forearms. Such exercise is specifically performed while executing a push-up upon a stable apparatus that is firmly in contact with the underlying surface. Furthermore, because rigid member 14 is removable and capable of coupling with other exercise devices, additional muscle groups may be exercised simultaneously with the wrists and forearms.

Although specific features of this invention are shown in some drawings and not others, this is for convenience only as some feature may be combined with any or all of the other features in accordance with this invention.

The foregoing is considered as illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of following claims:

I claim:

1. A push-up exercise apparatus, comprising:

a. a base;

b. at least two hand exercisers, each hand exerciser including a resilient coil spring having a first and second end that both extend perpendicularly away from a pivot axis to form an acute angle between said ends, a spring band in communication with each spring end to limit spring expansion, and a finger grip at the first end of said spring; and c. a rigid member having a means for removably coupling said rigid member to said base and a means for coupling said rigid member to the second ends of said hand exercisers; whereby said rigid member is no more than two feet above a support surface.

2. The push-up exercise apparatus of claim 1, in which said rigid member is substantially straight.

3. The push-up exercise apparatus of claim 2, in which said base includes a cross-member connected between a first support bar and a second support bar, wherein said cross-member is removably coupled to said rigid member.

4. The push-up exercise apparatus of claim 2, in which said base includes a first and a second U-shaped support member removably coupled to said rigid bar.

5. The push-up exercise apparatus of claim 2, in which said rigid member includes a means for removably coupling said rigid member to a second exercise apparatus.

6. The push-up exercise apparatus of claim 2, further including a pair of hand grips between each end of said rigid member.

7. A push-up exercise apparatus for use by a person performing push-ups, comprising:

a. a means for stably elevating the hands of said person no more than two feet above the underlying surface such that the chest of said person faces the underlying surface; and b. at least two hand exercisers coupled to said elevating means, in which each hand exerciser includes a resilient coil spring having a first and second end that both extend perpendicularly away from a pivot axis to form an acute angle between said ends and a spring band in communication with each spring end to limit spring expansion.

8. The push-up exercise apparatus of claim 7, in which said elevating means comprises a rigid member coupled to a base, said rigid member having a pair of hand grips between each end of said rigid member and a means for coupling said rigid member to the second ends of said hand exercisers.

9. The push-up exercise apparatus of claim 8, in which said rigid member is removably coupled to said base.

10. The push-up exercise apparatus of claim 8, in which said rigid member is substantially straight.

11. The push-up exercise apparatus of claim 8, in which said base includes a cross-member connected between a first support bar and a second support bar, wherein said cross-member is removably coupled to said rigid member.

12. The push-up exercise apparatus of claim 11, in which said first and second support bars each have a stop at the respective ends of said bars.

13. The push-up exercise apparatus of claim 8, in which said base includes a first and a second U-shaped support member removably coupled to said rigid bar.

14. The push-up exercise apparatus of claim 13, in which said first and second U-shaped support members each have a foot at the respective ends of said support members.

15. The push-up exercise apparatus of claim 8, in which said hand exercisers each include a finger grip at the first end of said spring.

16. The push-up exercise apparatus of claim 8, in which said hand exercisers are longitudinally positioned at opposite ends of said rigid member.

17. A push-up exercise apparatus, comprising:

a. a base to support said push-up apparatus upon an underlying static surface;

b. a rigid member coupled to said base; and c. a first and a second hand exerciser coupled to said rigid member, each hand exerciser having a pair of elongated fingers, a torsion spring pivotally connected between said fingers, said fingers separately integral to the respective ends of said spring, and a spring band connected between said fingers to limit spring expansion; whereby said rigid member is no more than two feet above a support surface.

18. The push-up exercise apparatus of claim 17, in which at least one of said fingers of each of said hand exercisers are connected to said rigid member.

19. The push-up exercise apparatus of claim 18, further including a removable connection means to couple said fingers to said rigid member, said removable connection means comprised of a synthetic connector in communication with a clip.

20. The push-up exercise apparatus of claim 18, further including a hand grip at each end of said rigid member.

21. The push-up exercise apparatus of claim 17, in which said base includes a cross-member connected between a first support bar and a second support bar, wherein said cross-member is removably coupled to said rigid member.

22. The push-up exercise apparatus of claim 17, in which said base includes a first and a second U-shaped support member removably coupled to said rigid bar.

* * * * *